US009941583B2

(12) United States Patent
Meyer

(10) Patent No.: US 9,941,583 B2
(45) Date of Patent: Apr. 10, 2018

(54) LIGHTNING PROTECTION DEVICE FOR AN ANTENNA RECEIVER, AND AIRCRAFT COMPRISING SAME

(75) Inventor: Marc Meyer, Launac (FR)

(73) Assignee: AIRBUS SAS, Blagnac (FR)

( * ) Notice: Subject to any disclaimer, the term of this patent is extended or adjusted under 35 U.S.C. 154(b) by 453 days.

(21) Appl. No.: 13/511,194

(22) PCT Filed: Nov. 22, 2010

(86) PCT No.: PCT/EP2010/067891

§ 371 (c)(1),
(2), (4) Date: Oct. 23, 2012

(87) PCT Pub. No.: WO2011/064157

PCT Pub. Date: Jun. 3, 2011

(65) Prior Publication Data

US 2013/0033402 A1 Feb. 7, 2013

(30) Foreign Application Priority Data

Nov. 24, 2009 (FR) ..... 09 58311

(51) Int. Cl.
*H01Q 1/50* (2006.01)

(52) U.S. Cl.
CPC ..... *H01Q 1/50* (2013.01)

(58) Field of Classification Search
CPC ..... H01Q 1/50
USPC ..... 343/749, 722, 713, 705; 361/119, 113, 361/212, 213
See application file for complete search history.

(56) References Cited

U.S. PATENT DOCUMENTS 4,513,338 A 4/1985 Goodall et al.
4,985,800 A * 1/1991 Feldman ..... H01P 1/202 333/12
5,939,766 A * 8/1999 Stolmeijer ..... H01L 23/5223 257/307
6,366,251 B1 * 4/2002 Pokryvailo ..... H01Q 1/002 343/722

(Continued)

FOREIGN PATENT DOCUMENTS

EP 0633622 1/1995
EP 2073305 6/2009

OTHER PUBLICATIONS

International search report dated Mar. 31, 2011 in corresponding PCT/EP2010/067891.

*Primary Examiner* — Dameon E Levi
*Assistant Examiner* — Walter Davis
(74) *Attorney, Agent, or Firm* — Greer, Burns & Crain Ltd.

(57) ABSTRACT

A lightning protection device for an antenna receiver includes a shield for a coaxial cable connected to the antenna, and a high-pass filter mounted in series relative to the shield and capable of limiting the low-frequency power flowing in the coaxial cable, including a capacitor and an inductor lower than 1 ohm at the lowest frequency used by the receiver, the capacitor including at least one layer of a conductive material embedded in a printed circuit. The capacitor may be made of a printed circuit including at least two floor plans, each of which is connected to the ground of a connector of the coaxial cable. The printed circuit may include at least one layer of a highly pervious material sandwiched between two layers of a conductive material.

20 Claims, 4 Drawing Sheets

(56) References Cited

U.S. PATENT DOCUMENTS

| | | | | |
|---|---|---|---|---|
| 7,033,934 | B2 * | 4/2006 | Iijima | H01L 23/49827 257/E23.067 |
| 2009/0322147 | A1 * | 12/2009 | Cooney | 307/9.1 |

* cited by examiner

LIGHTNING PROTECTION DEVICE FOR AN ANTENNA RECEIVER, AND AIRCRAFT COMPRISING SAME

BACKGROUND OF THE INVENTION

This invention relates to a lighting protection device for an antenna receiver in an aircraft and aircraft comprising same. This invention applies particularly to airplanes of which the fuselage contains electrically insulating materials, in particular composite materials.

Numerous antennas are installed on the fuselage of an aircraft. However, the widespread use of composite materials in the design of fuselages gives rise to numerous difficulties with relation to electrical conduction. In particular, significant contact resistance is present between the metallic bases of an antenna which is fixed to a fuselage and the composite panel onto which this base is fixed. The order of magnitude of this resistance is in the tens of Mega-Ohms. This high level of resistance causes current to circulate on the coaxial cable connected to the antenna when lightning strikes, on the order of 15 KA for a lightning strike of 200 KA, which is too restrictive for the connectors.

One solution under consideration is to connect the base of each antenna to metallic parts of nearby frames using metallic strips. This limits the amount of current shunted by the coaxial to 3 KA. However, this solution presents drawbacks, notably:

There are installation constraints.

It requires that the frames be metal plated, whereas it was determined that in some parts of aircraft carrying antennas that there should be no metal, which necessitates installing rather long strip lengths to reach other locations to which the metallic connection may be made.

BRIEF SUMMARY OF THE INVENTION

This invention aims to provide a remedy for these drawbacks. The present invention concerns, according to an initial aspect of it, a lightning protection device for an antenna receiver, characterized in that it contains a shield for a coaxial cable connected to the antenna and a high-pass filter mounted in series relative to this shield, to limit the low-frequency power flowing in said coaxial cable comprising a capacitor of at least one nF and an inductor lower than one Ohm at the lowest frequency used by said receiver, said capacitor including at least one layer of a conductive material embedded in a printed circuit board.

The capacitor should have a level of impedance sufficiently low in the area of antenna frequency that it will not introduce an undesirable standing-wave ratio and that it should be able to tolerate voltage in excess of 1 KV.

It should be noted that capacitance corresponds to high impedance in low frequencies and low impedance in high frequencies. This is true notably in the functional area ranging from 30 MHz to 1 GHz. Capacitance achieved with a discreet component can hardly meet both of these requirements simultaneously, because the components that can tolerate these voltage levels are frequently voluminous and have strongly inductive behavior with these frequencies, which would result in a significant standing-wave ratio. In the same way, a miniature surface mounted capacitor cannot tolerate high voltage levels because of its low inductive behavior. As an example, a capacitor that introduces inductance—inductance intrinsic to the component in addition to that introduced by routing—of 3 nH represents impedance of two Ohms at 100 MHz (a surface mounted component). For a capacitor introducing inductance of 10 nH, which should represent a minimum figure for capacitors tolerating the required voltage, we get six Ohms at 100 MHz and 18 Ohms at 300 MHz. These values will result in the introduction of an undesirable standing wave.

According to particular characteristics, capacitor is formed by a printed circuit board with two ground planes each connected to the ground of a coaxial cable connector.

According to particular characteristics, the printed circuit board contains at least one layer of highly permeable material sandwiched between two layers of conducting material.

Depending on particular characteristics, the printed circuit contains several layers of high permittivity material sandwiched between two layers of conducting material mounted in series.

In this way, voltage constraint is spread out over several layers. Moreover, this configuration of capacitors in series transforms current constraint in the receiver in voltage constraint at the capacitor terminals.

Depending on particular characteristics, the dielectric constant of the material separating the plates of the capacitor is greater than four.

Depending on particular characteristics, the thickness of the capacitor between its plates is greater than four microns.

Depending on particular characteristics, the surface of the capacitor plates is greater than one square centimeter.

Depending on particular characteristics, said capacitor is incorporated into a connector of the coaxial cable.

Depending on particular characteristics, said capacitor is incorporated into the coaxial cable.

According to a second aspect, this invention is intended for an aircraft with at least one antenna and at least one lightning protection device for a receiver of a said antenna, as described succinctly above.

The particular benefits, objectives and features of this aircraft are similar to those of the device that is the object of this invention, as described succinctly above. These are re-stated herein.

BRIEF DESCRIPTION OF THE DRAWINGS

Other benefits, objectives and characteristics of this invention will appear from the description given below, which is done with a purely explicative and in no way limiting purpose, with regard to the appended drawings, in which:

FIG. 1 schematically represents a particular embodiment of an aircraft that is the object of this invention, containing a plurality of lightning protective devices that are the object of this invention FIG. 2 schematically represents a particular embodiment of the lighting protective device that is the object of this invention, while

DETAILED DESCRIPTION OF THE PREFERRED EMBODIMENTS

Figure 1:
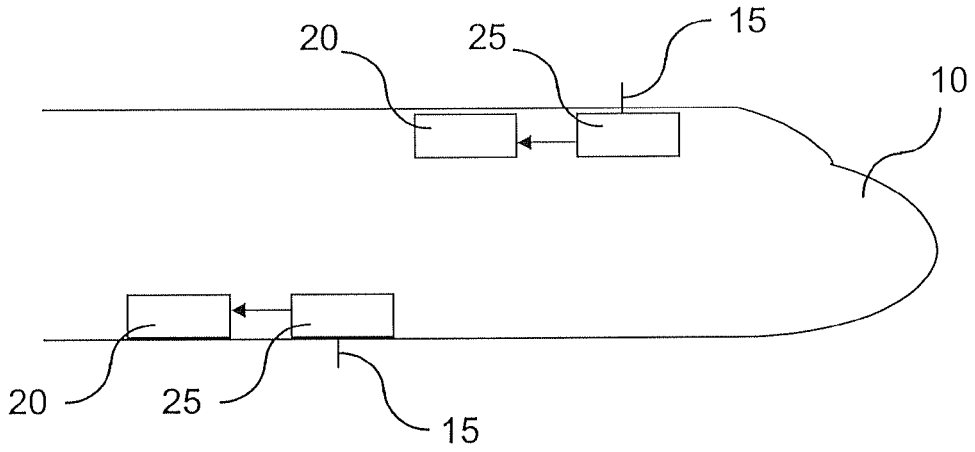

In FIG. 1, we observe an aircraft 10 containing antennas 15, antenna receivers 20 and lightning protection devices 25.

The aircraft 10 is of no particular type, it may be civilian or military, with or without pilots. In the preferred embodiments, the aircraft 10 has a fuselage comprising electrically insulating materials, notably composite materials. The antennas 15 are of a known type. Because of their shape and their position, they are particularly susceptible to lightning. The antenna receivers 20 or of a known type. They are connected to avionics and/or communications equipment, which is not shown. Each lightning protective device 25 is electrically inserted between an antenna 15 and an antenna receiver 20. A particular embodiment of a lightning protection device 25 is illustrated in FIG. 2.

Figure 2:
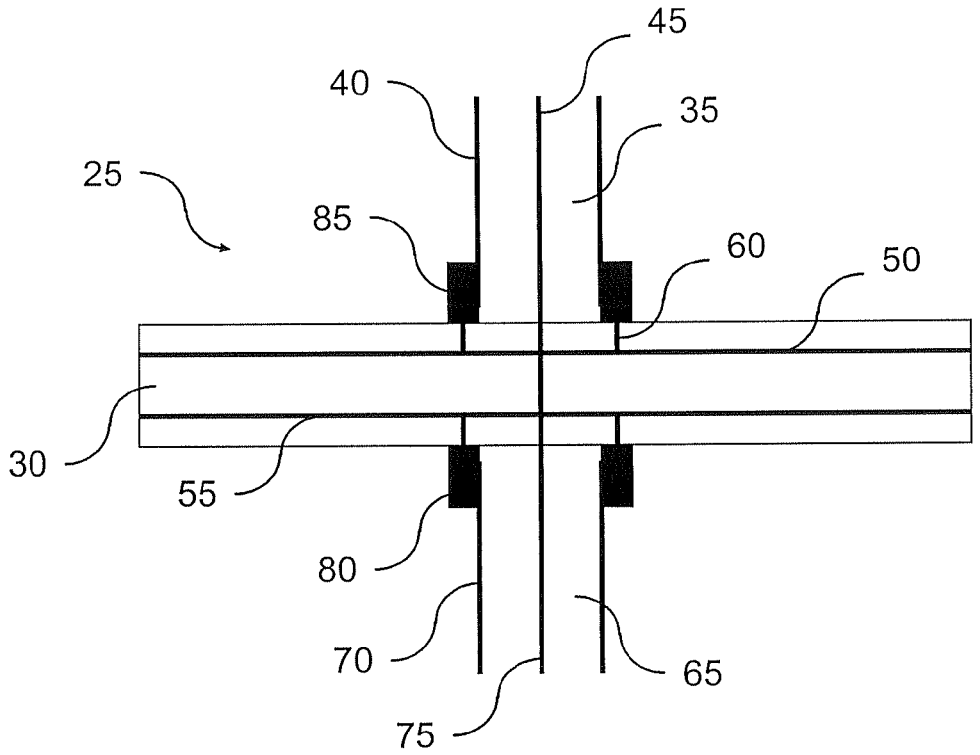

In the particular embodiment shown in FIG. 2, the lightning protection device 25 is based on a printed circuit board, or PCB, which is the acronym for "Printed Circuit Board" 30.

One may observe in FIG. 2 an input coaxial cable for transporting signals from the antenna 15 having a conducting external shield 40 and a core 45 connected to an antenna 15. This cable 35 is connected to the printed circuit board 30 by a connector 85. On the other side of the printed circuit board 30 a connector 80 links the printed circuit board 30 to an output coaxial cable 65 transporting signals from the antenna, the other end of which is connected to an antenna receiver 20. The coaxial cable 65 features external conducting shield 70 and a core 75.

The printed circuit board 30 contains two ground planes 50 and 55 that are layers of copper. The grounds of the connectors 80 and 85 are connected electrically, respectively to ground planes 55 and 50 by the intermediary of "vias", or metalized orifices.

In this way, a capacitor is integrated into the printed circuit board while maintaining a coaxial structure, which will prevent having inductors connected in series with the capacitor and will conserve standard impedance between the antenna and its receiver. The capacitance value used should be sufficient depending on the standing-wave ratio required for proper transmission of signals to or from the antenna.

The printed circuit board contains a layer of highly permeable material sandwiched between two layers of copper, for example, of the type C-ply (registered trademark), with a dielectric constant $\varepsilon r$ greater than four, and preferentially around or near 16. The thickness e of the printed circuit board between the ground planes is greater than four microns, and preferentially between eight and sixteen microns.

It should be noted that, in other embodiments, capacitor is formed by several layers of highly permeable material sandwiched between the electrically conducting planes, connected in series, so as to spread out voltage constraint over several layers.

In this respect, it can be noted that this configuration of capacitors in series transforms current constraint in the receiver in voltage constraint in the capacitor terminals.

The printed circuit board 30 thus acts as an interface between the antenna 15 and its receiver 20.

It should be noted that capacitance C of a condensator is calculated as follows: $C=\varepsilon_r \cdot \varepsilon_o \cdot S/e$ In which: $\varepsilon_o$ is the dielectric constant of the space ($1/36 \cdot \pi \cdot 10^9$) and S is the surface of the plates, in this example, the ground planes.

Where a thickness e=16 microns, we get a capacitance of around 1 nF per $cm^2$ of the ground plane of this material, so for a printed circuit of 100 $cm^2$ of surface, a capacitance of 100 nF.

At 100 MHz, impedance is $Z=15.10^{-3}$ Ohms
At 300 MHz, impedance is $Z=5.10^{-3}$ Ohms
For 10 nF (area of 10 $cm^2$)
At 100 MHz, impedance is $Z=150.10^{-3}$ Ohms
At 300 MHz, impedance is $Z=50.10^{-3}$ Ohms
For 1 nF (area of 1 $cm^2$)
At 300 MHz, impedance is $Z=500.10^{-3}$ Ohms Preferably, the area of the plates shall be greater than one $cm^2$ and capacitance shall be greater than 1 nF.

The non-inductive behavior of the device keeps impedance below 1 Ohm, which will limit the standing-wave ratio.

The structure recommended will provide sufficient impedance at low frequency to limit current produced by lightning without upsetting the functional transmission signal of the antenna to its receiver, which is deemed to be around 300 MHz.

Figure 3:
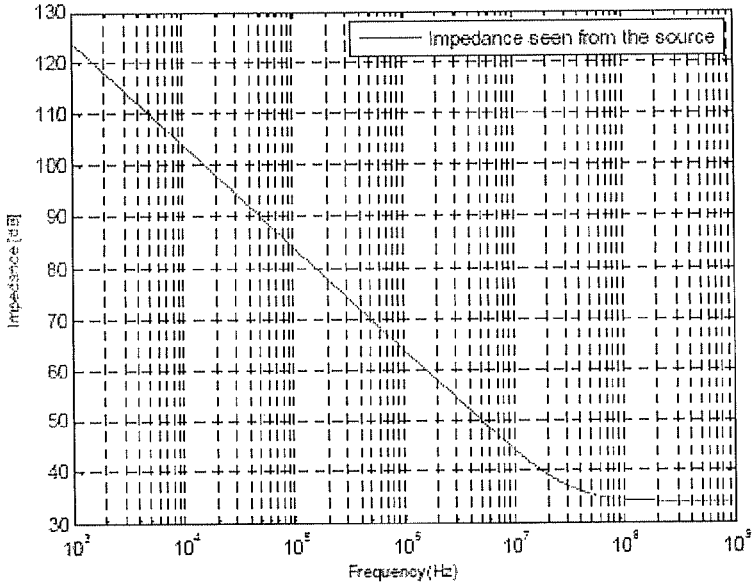
FIGS. 3 to 8 represent the impedance curves for different frequencies As a preliminary note, it should be observed that the figures are not to scale.
Figure 4:
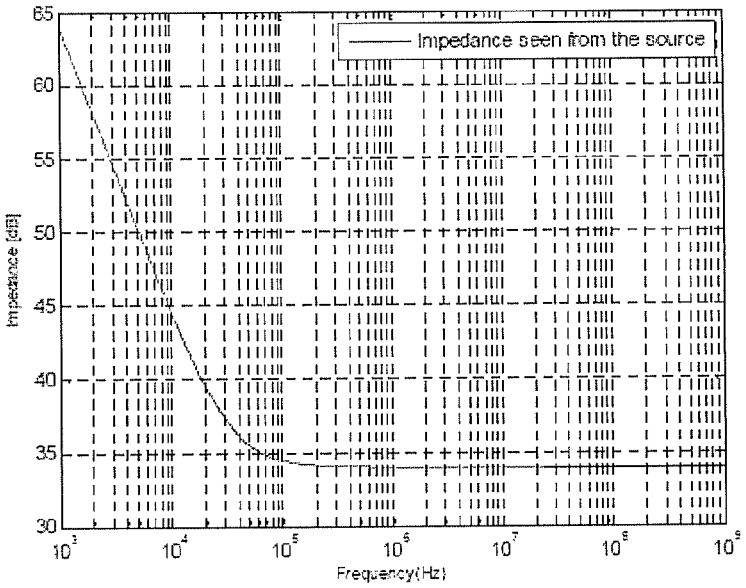

Without a coaxial cable, impedance seen from the source is obtained as shown in FIG. 3, with a capacitance of 100 pF. Likewise, with a capacitance of 100 nF, impedance seen from the source is obtained as shown in FIG. 4.

Figure 5:
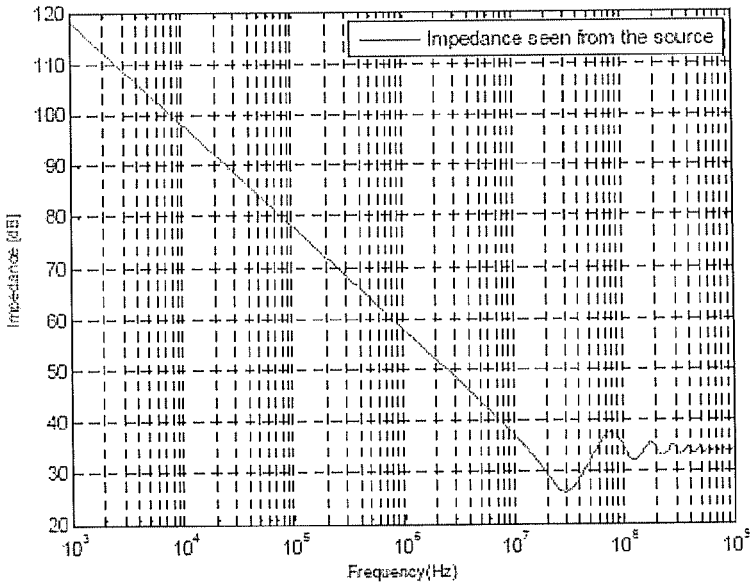

By inserting one meter of coaxial cable, which represents impedance of 50.6 Ohms, on either side of the capacitor, impedance is obtained as shown in FIG. 5, with capacitance of 100 pF. In this case, the capacitance value is too weak because it exerts too much influence at around 100 MHz.

Figure 6:
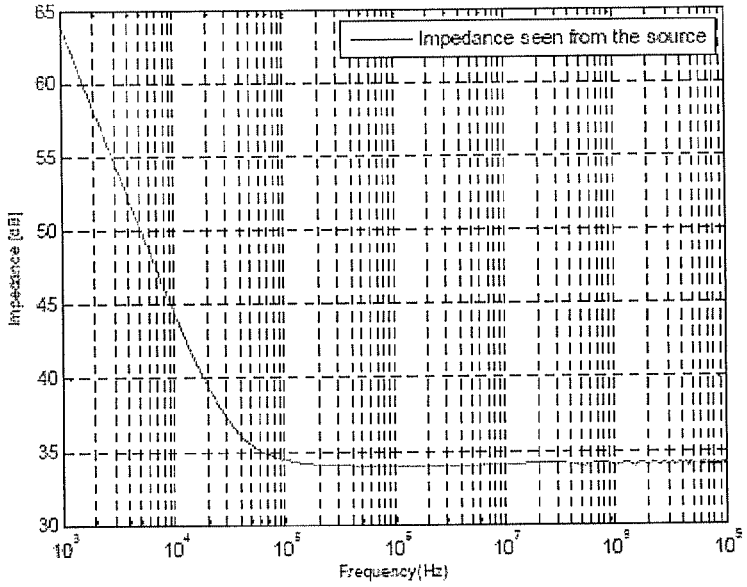

By inserting one meter of coaxial cable, which represents impedance of 50.6 Ohms, on either side of the capacitor, impedance is obtained as shown in FIG. 6, with capacitance of 100 nF.

Figure 7:
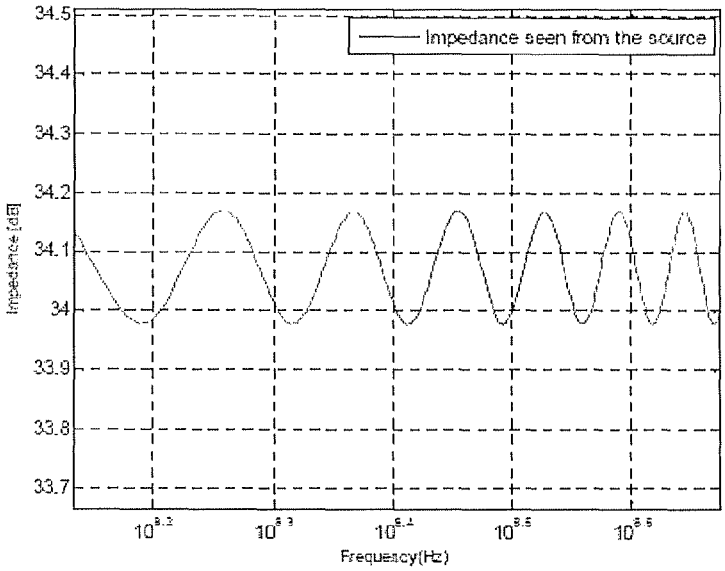

FIG. 7 shows the curve in FIG. 6 around a frequency of 300 MHz with greater accuracy.

Characteristic impedance of the cable is 50.6 Ohms, which corresponds to 34.08 dB Ohm. With this capacitance value, impedance variation is a maximum of +/−0.1 dB Ohm, which corresponds to 1 Ohm, or 2% of characteristic impedance.

Figure 8:
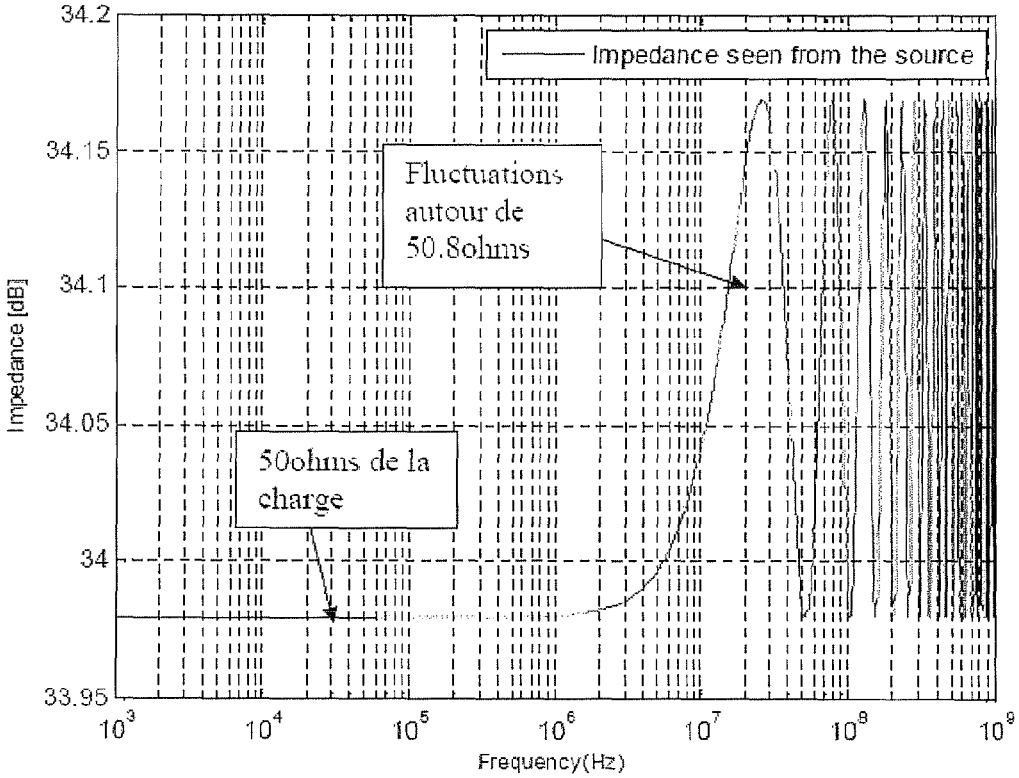

This variation is due to the fact that the cable does not register 50 Ohms perfectly and if the filtering capability where to be removed, impedance would be that as shown in FIG. 8.

Oscillations beyond 100 MHz are due to the fact that the cable does not perfectly retain impedance of 50 Ohms at all frequencies. Thus, oscillations observed in the presence of filtering capacity of the device 25 are not due to this filtering capacity.

In the embodiment described, the device 25 carries out a high-pass filter mounted in series of the shield of the coaxial cable, modified to limit low energy frequency circulating on the coaxial cable. It includes a capacity of lower than one nF and inductance lower than one Ohm for the lowest frequency used by the antenna receiver, here 30 MHz.

The device 25 features a level of impedance sufficiently low in the area of antenna frequency that it will not introduce an undesirable standing-wave ratio. The device 25, furthermore tolerates voltage levels of higher than 1 KV.

The invention claimed is:

1. A lightning protection device for an antenna connecting to an antenna receiver, comprising:

a printed circuit board with a first side and an opposite, second side, the printed circuit board being comprised of a first ground plane spaced apart from a second ground plane and at least one layer of a conductive material, the printed circuit board being further comprised of a first via extending from a surface of the first side to the first ground plane and a second via extending from a surface of the second side to the second ground plane, the first ground plane being a first plate and the second ground plane being a second plate;

an input coaxial cable connectable to the antenna, the input coaxial cable for transporting signals from the antenna, the input coaxial cable having a first conducting external shield and a first core, the first core connectable to the antenna;

a first connector that connects the input coaxial cable to the first side of the printed circuit board, wherein a ground of the first connector is electrically connected to the first ground plane by the first via;

an output coaxial cable connectable to the antenna receiver, the output coaxial cable for transporting signals to the antenna receiver, the output coaxial cable having a second conducting external shield and a second core, the second core connectable to the antenna receiver;

a second connector that connects the output coaxial cable to the second side of the printed circuit board, wherein a ground of the second connector is electrically connected to the second ground plane by the second via; and wherein the first and second ground plates and the at least one layer of a conductive material within the printed circuit board together form a capacitor of at least one nF and an inductor lower than one Ohm at a lowest frequency used by said receiver, wherein the printed circuit board further defines a high-pass filter mounted in series relative to the first and second conducting external shields, the high-pass filter adapted to limit low-frequency power flowing in said output coaxial cable, the high-pass filter being comprised of the capacitor.

2. The device according to claim 1, wherein, the at least one layer of a conductive material includes two layers of conducting material, and the printed circuit board contains at least one layer of high permittivity material sandwiched between the two layers of conducting material.

3. The device according to claim 1, wherein, the at least one layer of a conductive material includes two layers of conducting material, and the printed circuit board contains plural layers of high permittivity material sandwiched between the two layers of conducting material, mounted in series.

4. The device according to claim 1, wherein said capacitor is incorporated into the first and second connectors.

5. The device according to claim 1, wherein said capacitor is incorporated into the said input and output coaxial cables.

6. The device according to claim 1, wherein a dielectric constant of the material separating the first and second plates of the capacitor is greater than four.

7. The device according to claim 1, wherein a thickness of the printed circuit board between the first and second ground plates is greater than four microns.

8. The device according to claim 1, wherein an area of each of the first and second plates of the capacitor is greater than one square centimeter.

9. An aircraft comprising:

an antenna;

an antenna receiver; and lightning protection device that comprises a printed circuit board with a first side and an opposite, second side, the printed circuit board being comprised of a first ground plane spaced apart from a second ground plane and at least one layer of a conductive material, the printed circuit board being further comprised of a first via extending from a surface of the first side to the first ground plane and a second via extending from a surface of the second side to the second ground plane, the first ground plane being a first plate and the second ground plane being a second plate;

an input coaxial cable connectable to the antenna, the input coaxial cable for transporting signals from the antenna, the input coaxial cable having a first conducting external shield and a first core, the first core connectable to the antenna;

a first connector that connects the input coaxial cable to the first side of the printed circuit board, wherein a ground of the first connector is electrically connected to the first ground plane by the first via;

an output coaxial cable connectable to the antenna receiver, the output coaxial cable for transporting signals to the antenna receiver, the output coaxial cable having a second conducting external shield and a second core, the second core connectable to the antenna receiver;

a second connector that connects the output coaxial cable to the second side of the printed circuit board, wherein a ground of the second connector is electrically connected to the second ground plane by the second via; and wherein the first and second ground plates and the at least one layer of a conductive material within the printed circuit board together form a capacitor of at least one nF and an inductor lower than one Ohm at a lowest frequency used by said receiver, wherein the printed circuit board further defines a high-pass filter mounted in series relative to the first and second conducting external shields, the high-pass filter adapted to limit low-frequency power flowing in said output coaxial cable, the high-pass filter being comprised of the capacitor.

10. The device of claim 1, wherein each of the first and second vias are metalized orifices.

11. The aircraft of claim 9, wherein each of the first and second vias are metalized orifices.

12. The device according to claim 1, wherein a thickness of the printed circuit board between the first and second ground plates is between eight and sixteen microns.

13. The aircraft according to claim 9, wherein a thickness of the printed circuit board between the first and second ground plates is greater than four microns.

14. The aircraft according to claim 13, wherein a thickness of the printed circuit board between the first and second ground plates is between eight and sixteen microns.

15. The aircraft according to claim 14, wherein an area of each of the first and second plates of the capacitor is greater than one square centimeter.

16. The aircraft according to claim 15, wherein a dielectric constant of the material separating the first and second plates of the capacitor is greater than four.

17. The device according to claim 1, wherein, a dielectric constant of the material separating the first and second plates of the capacitor is greater than four, a thickness of the printed circuit board between the first and second ground plates is between eight and sixteen microns, and an area of each of the first and second plates of the capacitor is greater than one square centimeter.

18. A lightning protection device for an aircraft antenna connecting to an antenna receiver of an aircraft, the lightning protection device comprising:

a printed circuit board with a first side and an opposite, second side, the printed circuit board being comprised of a first ground plane spaced apart from a second ground plane and at least one layer of a conductive material, the first ground plane being a first plate and the second ground plane being a second plate;

an input coaxial cable connectable to the antenna, the input coaxial cable for transporting signals from the aircraft antenna, the input coaxial cable having a first conducting external shield and a first core, the first core connectable to the aircraft antenna;

a first connector that connects the input coaxial cable to the first side of the printed circuit board, wherein a ground of the first connector is electrically connected to the first ground plane;

an output coaxial cable connectable to the aircraft antenna receiver, the output coaxial cable for transporting signals to the antenna receiver, the output coaxial cable having a second conducting external shield and a second core, the second core connectable to the antenna receiver;

a second connector that connects the output coaxial cable to the second side of the printed circuit board, wherein a ground of the second connector is electrically connected to the second ground plane; and wherein the first and second ground plates and the at least one layer of a conductive material within the printed circuit board together form a capacitor of at least one nF and an inductor lower than one Ohm at a lowest frequency used by said receiver, wherein the printed circuit board further defines a high-pass filter mounted in series relative to the first and second conducting external shields, the high-pass filter adapted to limit low-frequency power flowing in said output coaxial cable, the high-pass filter being comprised of the capacitor.

19. The device according to claim 18, wherein, a dielectric constant of the material separating the first and second plates of the capacitor is greater than four, a thickness of the printed circuit board between the first and second ground plates is between eight and sixteen microns, and an area of each of the first and second plates of the capacitor is greater than one square centimeter.

20. The device according to claim 19, wherein, the at least one layer of a conductive material includes two layers of conducting material, and the printed circuit board contains at least one layer of high permittivity material sandwiched between the two layers of conducting material.

* * * * *